United States Patent [19]

Alexander

[11] 4,217,998

[45] Aug. 19, 1980

[54] ADJUSTABLE WEIGHT BALANCING DEVICE FOR A BACKPACK FRAME

[76] Inventor: James E. Alexander, 13739 Woodcock Ave., Sylmar, Calif. 91342

[21] Appl. No.: 17,440

[22] Filed: Mar. 5, 1979

Related U.S. Application Data

[63] Continuation of Ser. No. 684,742, May 10, 1976, abandoned.

[51] Int. Cl.[3] ..... A45F 3/10

[52] U.S. Cl. ..... 224/261; 224/210

[58] Field of Search ..... 224/210, 211, 212, 213, 224/261, 262, 263, 907

[56] References Cited

U.S. PATENT DOCUMENTS

| | | | |
|---|---|---|---|
| 178,545 | 6/1876 | Merriam | 224/213 |
| 3,734,367 | 5/1973 | Jackson | 224/262 |
| 3,889,859 | 6/1975 | Joseph | 224/211 |
| 3,899,109 | 8/1975 | Noice | 224/262 |

FOREIGN PATENT DOCUMENTS

| | | | |
|---|---|---|---|
| 861216 | 2/1941 | France | 224/213 |
| 76066 | 12/1948 | Norway | 224/210 |
| 71208 | 6/1950 | Norway | 224/211 |
| 85623 | 5/1955 | Norway | 224/210 |
| 431119 | 7/1935 | United Kingdom | 224/210 |

*Primary Examiner*—Robert J. Spar
*Assistant Examiner*—Jerold M. Forsberg
*Attorney, Agent, or Firm*—John J. Posta, Jr.

[57] ABSTRACT

The novel weight-balancing device of the present invention is adapted for use in the improved backpack of the present invention. The device comprises a set of two elongated tubes, disposed in telescoping relation to each other with a spring-loaded push button carried by the inner tube adjustably releasably locking the tubes together so that they can have various desired combined lengths. One of the tubes has a slip resistant backpack shoulder strap connector attached at its front end and the other of the tubes has a backpack rear frame connector pivotally secured to its rear end.

The improved backpack utilizes a pair of the described novel devices, connected to opposite sides of the backpack rear frame and projecting forwardly to engage the two backpack shoulder straps. Thus, the two devices are disposed on opposite sides of the backpacker. Their purpose is to shift the center of gravity and balance of the backpack from aft of the vertical midline of the backpacker when standing erect with the backpack in place, that is, from a very uncomfortable and clumsy position to a more forward comfortable position adjacent that vertical midline of the backpacker, without the backpacker having to continually tug at the backpack shoulder straps and hunch over to achieve the weight shift. The device is simple, inexpensive, light in weight, durable, easy to install and remove, and is very efficient.

8 Claims, 7 Drawing Figures

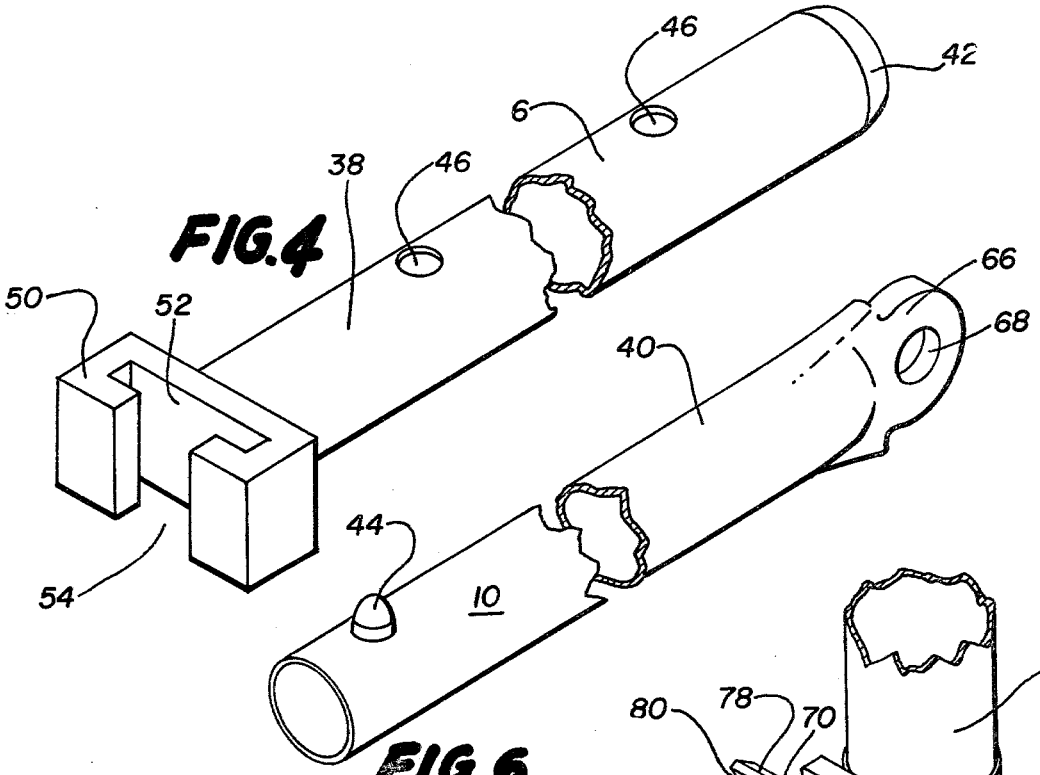
FIG.4
FIG.6
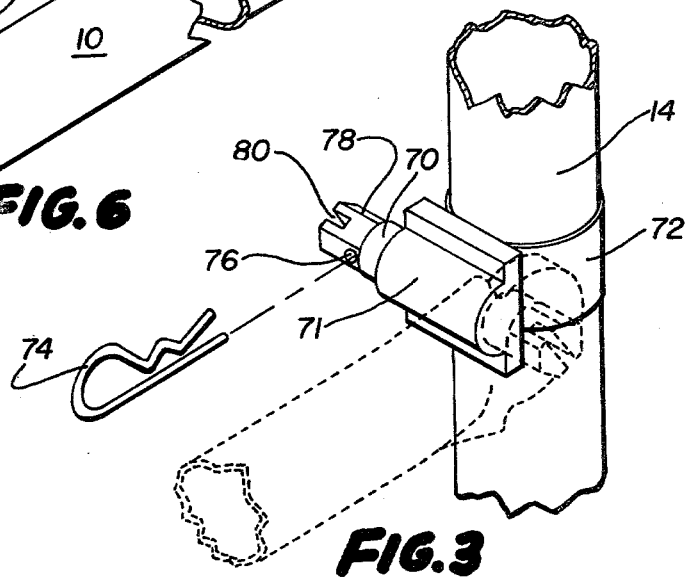
FIG.3
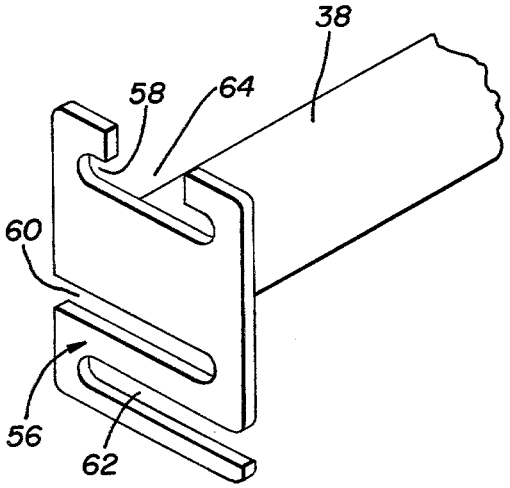
FIG.5
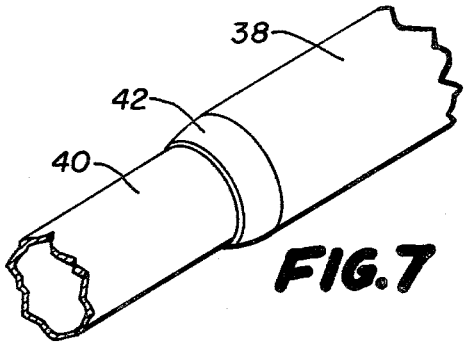
FIG.7

ADJUSTABLE WEIGHT BALANCING DEVICE FOR A BACKPACK FRAME

BACKGROUND OF THE INVENTION

1. Field of the Invention

This application is a continuation of my previously filed application Ser. No. 684,742 filed May 10, 1976, which is now abandoned.

The present invention generally relates to backpacks and more particularly to weight balancing means for backpacks, and backpacks incorporating the same.

2. Prior Art

Backpacks are being utilized in ever increasing numbers as the popularity of hiking and other outdoor recreational activities increase. Conventional backpacks are generally in the form of vertically extending rear frames of metal, wood, plastic or the like adapted to be worn on the packer's back and to which are attached at vertically spaced intervals a pair of forwardly extending shoulder straps, each strap forming a loop with the rear frame. Most conventional backpacks also have shoulder pads and certain ones have the bottom of the rear frame and/or shoulder straps connected to a padded or unpadded hip or back belt. The load to be carried is generally tied to the rear frame so that, as described above, the center of gravity of the entire assembly when the backpacker is standing with the backpack in place is behind the packer's vertical mid-line. This usually causes the packer to feel pulled back and off-balance, and to try to compensate for this by hunching forward and/or repeatedly pulling forward and down on the backpack shoulder straps in order to help shift the pack load up and forward to a position more closely adjacent to the described vertical mid-line. However, walking while hunched forward is inefficient and tiring, placing considerable strain on back muscles and impeding a free and easy gait. Moreover, repeatedly tugging at the backpack shoulder straps while walking is also tedious and distracting, resulting in a repeated shifting back and forth of the center of gravity of the backpack, and thus also making the walking uncomfortable, tiring and uneven.

There still is a substantial need for an improved backpack and/or device for improving the same so as to achieve better backpack balance while walking.

SUMMARY OF THE INVENTION

The novel weight balancing device of the present invention and the improved backpack incorporating the same satisfy all the foregoing needs. The device and backpack are substantially as set forth above. Thus, the device comprises a pair of elongated preferably tubular support members joined in telescoping adjustable relation by a releasable lock, such as a spring loaded button on one member recessible within any selected one of a plurality of holes in the other member. One of these two telescoping members has a anti-slip adjustable shoulder strap-receiving connector on its front end and the other of these two telescoping members has a clamp pivotally connected to its rear end, the clamp being adapted to releasably engage one of the vertical side members of the rear pack frame. Thus, a pair of these devices are installable on opposite sides of the rear frame and extend forward to connect with the shoulder straps on their respective sides. The length of each device and the position of each device onto each shoulder strap and each rear frame vertical member is readily adjustable so as to cause a desired shifting of the pack weight center of gravity up and forward to any desired degree to obtain the balance required for easy balanced walking with the pack load. For example, either lowering the front points of connection of the devices with the backpack or lengthening the devices will cause the center of gravity of the pack load to rise and shift forward. This change in balance will be retained until any other adjustment is desired. The devices are simple and easy to install on the pack and also to remove therefrom when desired. Moreover, the devices are inexpensive, durable and efficient for weight-shifting purposes. Further features of the present invention are set forth in the following detailed description and accompanying drawings.

DRAWINGS

FIG. 3 is a schematic perspective view of the clamp and extension used to connect the device of FIG. 1 to a vertical rear frame member;

FIG. 4 is a schematic perspective view of the connector used to attach the device of FIG. 1 to a shoulder strap;

FIG. 5 is a schematic perspective view of a modification of the shoulder strap connector shown in FIG. 1, said modification including strap anti-slip means;

FIG. 6 is a schematic perspective view of the rear end of the device of FIG. 1, illustrating the pivot point thereof for connection with the clamp extension of FIG. 3; and, FIG. 7 is a fragmentary schematic perspective view of the device of FIG. 1, illustrating the spin or necked down portion of the outer tube thereof and its sliding telescopic fit with the inner tube thereof.

DETAILED DESCRIPTION

Figure 1:
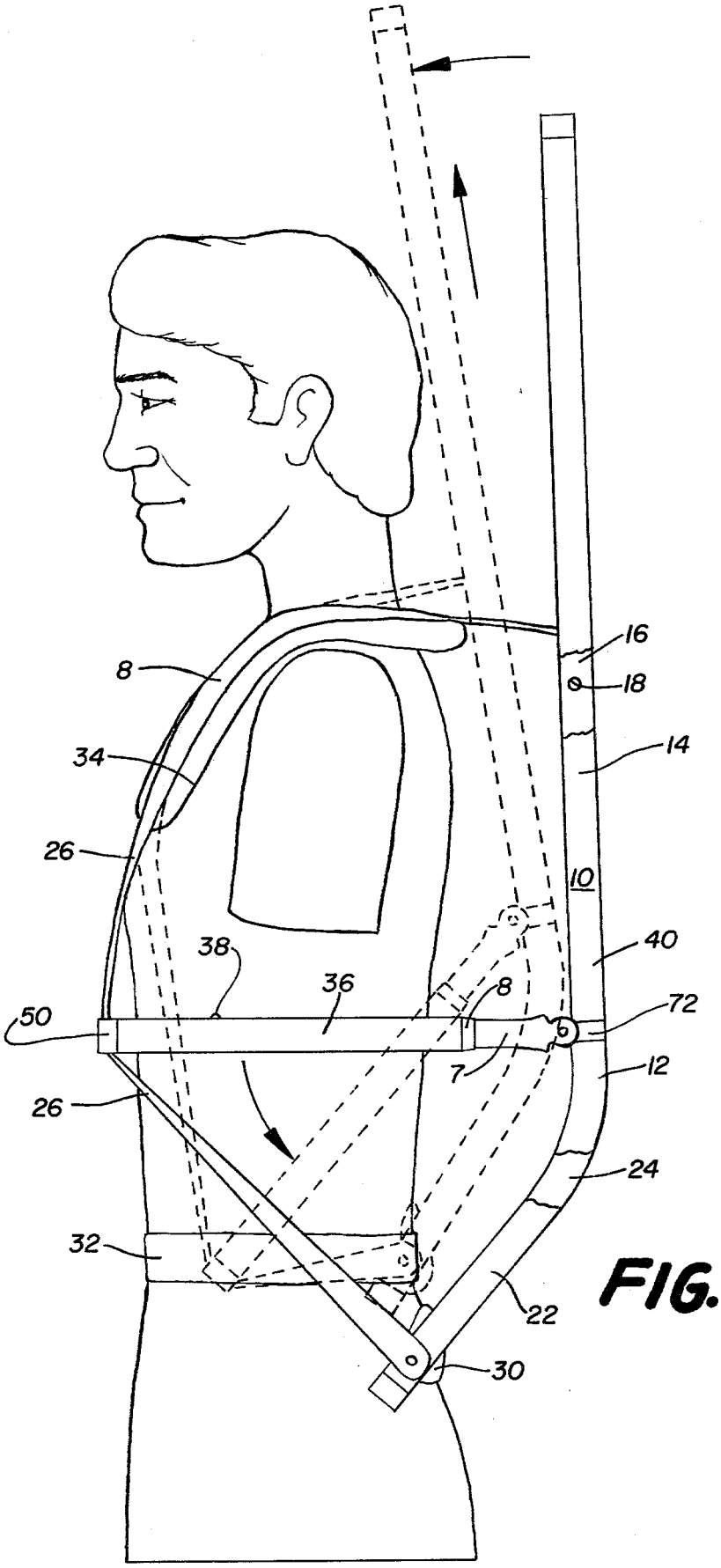
FIG. 1 is a schematic side elevation of a preferred embodiment of the novel weight balancing device and improved backpack of the present invention showing them in position on a backpacker.
Figure 2:
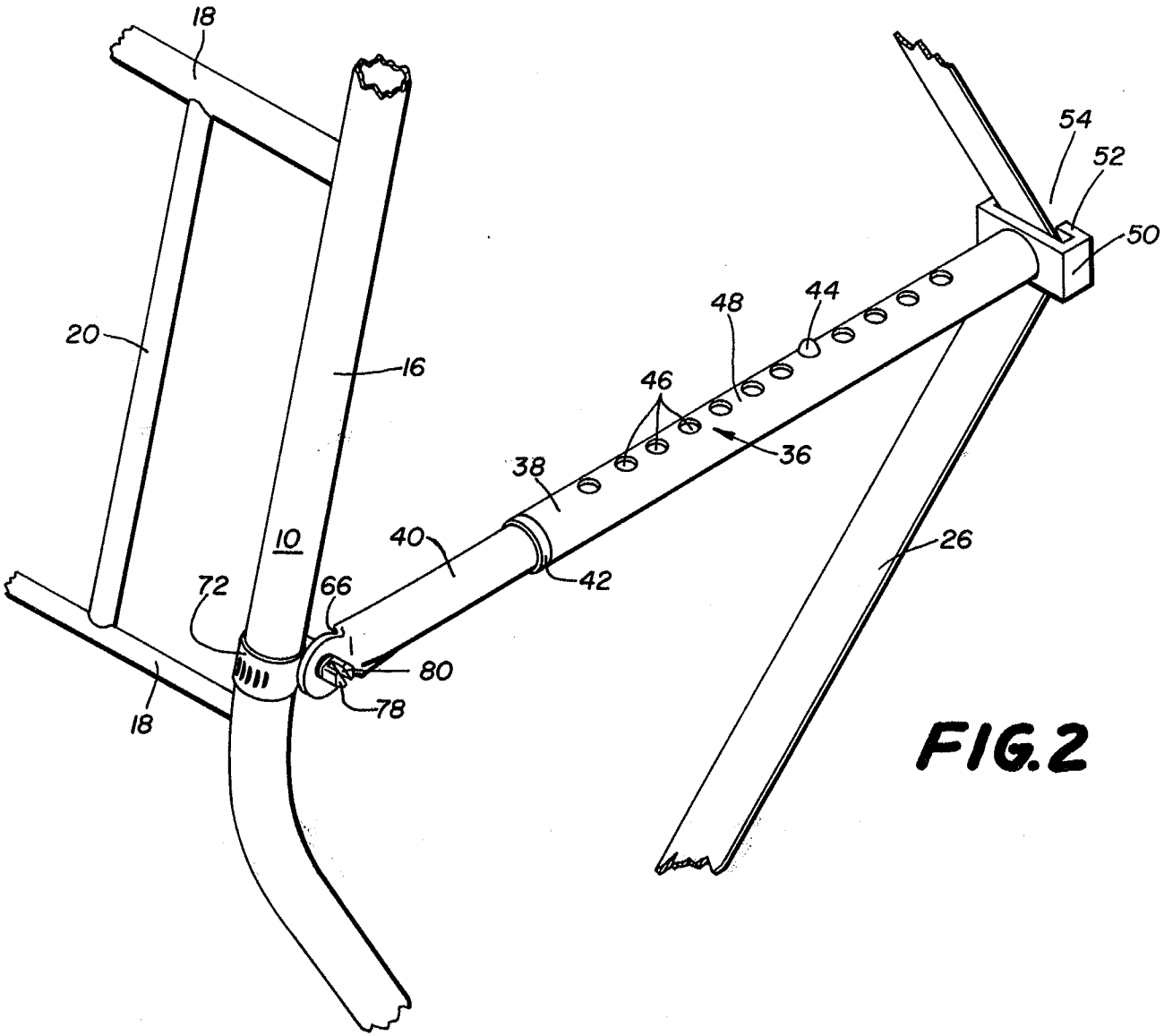
FIG. 2 is an enlarged schematic perspective view of the novel weight balancing device of FIG. 1 installed on a shoulder strap and vertical rear frame member of FIG. 1.

Now referring more particularly to FIG. 1 of the drawings, a preferred embodiment of the improved backpack of the present invention is schematically depicted in place on a backpacker. Thus, backpack 10 is schematically shown in side elevation. Backpack 10 comprises an elongated upstanding rear frame 12 constructed of metal, wood, plastic, or the like and comprising a pair of generally vertically extending tubular frame members 14 and 16 maintained in parallel side-by-side relation by a plurality of tubular crossbars 18 (FIGS. 1 and 2) in turn supported by a plurality of vertical tubular braces 20 (FIG. 2). Members 14 and 16 may curve forward adjacent their lower ends 22 and 24, as shown in FIG. 1, or may be straight.

Backpack 10 also includes a pair of flexible shoulder straps 26, of cloth, leather or the like, the ends of each strap 26 being affixed to one of the tubular members 14 and 16 at two different locations spaced vertically along those members, as shown in FIG. 1, the lower location in each instance being at the curved lower end 22 or 24. The upper points of attachment of straps 26 are parallel with each other, as are the lower points of attachment. Each shoulder strap 26 is provided with a pad 28. Backpack 10 may also include a back belt 30 in the form of a loop attached to and depending from a waist belt 32 around the waist of the backpacker 34. Belt 30 is of sufficient width to extend from end 22 to end 24 and is attached to both in order to help support the weight of a pack load (not shown) which can be strapped to the back of frame 12.

Backpack 10 further includes a pair of the novel weight-balancing devices of the present invention releasably installed thereon. Thus, a pair of devices 36 are provided, each device comprising a pair of elongated hollow tubular support members 38 and 40 (FIG. 2), member 40 being dimensioned to slide within member 38. For this purpose, one end 42 of member 38 may be spun or necked down to create the desired fit. Each of devices 36 include locking means installed on the set of tubes 38 and 40 to releasably adjustably lock them together in telescoped position at the desired overall length. For such purposes, the locking means may include a spring loaded, depressible, pop-up type button 44 affixed to tube 40 and extending outwardly therefrom, and a plurality of aligned, spaced apertures 46 extending through the wall 48 of tube 38 (FIG. 2) along the length thereof. Each of apertures 46 is of sufficient diameter to just fully receive button 44 so as to releasably lock tube 40 in the desired position relative to tube 38. It will be understood that members 38 and 40 could, if desired, be made in a different configuration, for example, flat member 40 slideably received in a channel in member 38 (not shown). Other locking means could also be used in place of those described above.

Each device 36 also includes connector means secured to the members 38 and 40 releasably connecting them to the shoulder strap 26 and tubular members 14 or 16, as shown in FIG. 1. Those connector means comprise a bracket 50 secured to the front end of tube 38 (FIG. 2) and configured to define a vertical strap 26 receiving channel or slot 52 therein and a narrow front opening 54 providing access to slot 52. Thus, device 26 can be adaptably positioned relative to strap 26.

A modified bracket 56 is schematically depicted in FIG. 1 in perspective view attached to tube 38 in place of bracket 50. Bracket 56 has three horizontal strap 26 receiving slots 58, 60 and 62 in it disposed in vertically spaced relation, slot 58 communicating with a narrowed central upper access opening 64, slot 60 being open at one side of bracket 56 and slot 62 being open at the opposite side of bracket 56. Strap 26 is installed on bracket 56 by passing strap 26 forwardly through slot 58, then down over the front of bracket 56, then rearwardly through slot 60, and then forwardly through slot 62, that is, in a serpentine anti-skid path to help adjustably lock bracket 56 and tubes 38 and 40 in place relative to strap 26.

Each device 26 is releasably connected to one of vertical rear frame tubes 14 and 16 by suitable connector means. Thus, tube 40 (FIG. 6) may have its rear end 66 flattened into a vertical plate configuration defining a central transverse aperture 68 rotatably received over an arm 70 disposed in a bracket 71. Arm 70 forms with bracket 71 a transverse extension of an openable circular clamp 72 releasably secured around tube 14 or 16. End 66 may be releasably pinned in place, as by a clip 74 removably disposed in an opening 76 extending through the end 78 of arm 70. Arm 70 may be rotated in bracket 71 to loosen or tighten clamp 72 and in such event end 78 may be provided with a slot 80 to facilitate such rotation. Bracket 71 can be installed facing inboard or outboard to provide lesser or greater spacing between devices 36, as desired, depending on the width of backpacket 34. It will be understood that other suitable means of releasably securing the rear end of device 36 to one of vertical tubes 14 and 16 can be used in place of the described mechanism, if desired.

Thus, each device 36 is releasably secured to a strap 26 and tube 14 or 16 on one side of backpack 10, the pair of devices 36 being installed on opposite sides to complete the assembly shown in FIG. 1. Each device 36 can, if desired, just as easily be removed from backpack 10.

In order to properly balance backpack 10, it is necessary to adjust the combined length of each pair of tubes 38 and 40 and the relative position of each pair of tubes 38 and 40 with its associated strap 26 and rear frame tube 14 or 16. This is easily done by means of button 38, by forcing bracket 50 or 56 up or down on strap 26 and by loosening clamp 72 and sliding it up or down on tube 14 or 16 and retightening clamp 72 as desired. In most instances, the desired positions of bracket 50 and clamp 72 will be the same for both devices 36. When it is desired to move the center of gravity of a loaded backpack 10 up and forward a certain amount relative to hiker 36 for greater comfort, lengthening of the overall combined length of each set of tubes 38 and 40 will help to force backpack 10 up. Lowering of brackets 50 on straps 26, as shown in dotted outline in FIG. 1, relative to the positions of clamps 72 will force backpack 10 up and forward. When tubes 38 and 40 of each device 26 are about horizontal, backpack 10 will stand just clear of the hiker's back (solid outline in FIG. 1). Lowering of clamps 72 on tubes 14 and 16 also tends to somewhat increase lift. Experimentation by hiker 34 with adjustments of the positions of brackets 50 and clamps 72 and the length of tube sets 88–40 for a given backpack load, distribution and size easily results in obtaining efficient comfortable pack load weight distribution and balance for backpack 10 on backpacker 34.

Various modifications, changes, alterations and additions can be made in the novel weight-balancing device of the present invention, its components, and parameters, and in the improved backpack of the present invention, its components and parameters. All such modifications, changes, alterations and additions as are within the scope of the appended claims form part of the present invention.

What is claimed is:

1. An improved backpack, said backpack comprising, in combination:

a. an elongated rear frame having a pair of laterally spaced generally vertically extending frame members;

b. a pair of shoulder straps, each said strap being connected to one of said rear frame members at two spaced points, one above the other, said strap extending forward; and, c. a pair of novel weight-balancing devices, each said device comprising, in combination, i. a first elongated support member projecting forward of said rear frame, ii. a second elongated support member projecting forward of said rear frame, iii. lock means adjustably releasably locking said first and second elongated support members together in telescoping relation, iiii. retaining means secured to one end of said first elongated support member and releasably receiving one of said shoulder straps along the length thereof, iiiii. rear frame engaging means secured to one end of said second elongated support member and releasably engaged to said one of said rear frame members, d. each of said two weight balancing devices being disposed in side by side, spaced, general parallel relation, attached to separate ones of said shoulder straps and rear frame members, and e. whereby the relationship of said frame with respect to the wearer thereof can be changed by movement of said retaining means along the length of the shoulder strap.

2. The improved backpack of claim 1 wherein said first and second elongated, forwardly projecting support members are hollow tubular members, with said hollow tubular member disposed within said first tubular member.

3. The improved backpack of claim 2 wherein said lock means comprises a depressible spring loaded button extending outwardly of said second tubular member and releasably receivable within a plurality of openings spaced along the length of said first tubular member.

4. The improved backpack of claim 1 wherein each of said retaining means includes anti-slip means.

5. The improved backpack of claim 1 wherein each of said pair of rear frame engaging means includes a clamp releasably gripping one of said rear frame members and having an extension to which the rear end of one of said forwardly projecting elongated support members is pivotally connected through a pivotal connection.

6. The improved backpack of claim 3 wherein said pivotal connection is a releasably pivotal connection.

7. The improved backpack of claim 6 wherein each said retaining means is disposed on the front end of one of a set of said forwardly extending elongated first and second support members, wherein each said extension is secured to the rear end of the other of said set of two forwardly extending elongated support members, wherein said first and second support members in each set are hollow tubes disposed in telescoping relation and secured together by a depressible spring loaded button on one of said tubes releasably disposed in any one of a plurality of openings in the other of the tubes of said set, and wherein said rear frame members are generally vertical tubes.

8. The improved backpack of claim 7 wherein said generally vertical rear frame member tubes are forwardly curved adjacent the lower ends thereof and the low ends of said shoulder straps are secured thereto adjacent said rear frame tube lower ends, and wherein said backpack includes a belt support connected to said lower ends of said rear frame tubes.

* * * * *